United States Patent [19]

Gellert

[11] Patent Number: 5,026,007

[45] Date of Patent: Jun. 25, 1991

[54] KITE CONTROLLER

[76] Inventor: Donald P. Gellert, Birchwood #9 South Down Shores, Laconia, N.H. 03246

[21] Appl. No.: 487,523

[22] Filed: Mar. 2, 1990

[51] Int. Cl.[5] ..... B64C 31/06

[52] U.S. Cl. ..... 244/155 A

[58] Field of Search ..... 244/153 R, 155 R, 155 A; 446/30–33; 242/96

[56] References Cited

U.S. PATENT DOCUMENTS

| | | | |
|---|---|---|---|
| 2,561,760 | 7/1951 | Stifter | 446/30 |
| 2,947,108 | 8/1960 | Dodd et al. | 446/30 |
| 3,355,129 | 11/1967 | Kinsey | 244/155 A |
| 3,421,722 | 1/1969 | May et al. | 244/155 A |

OTHER PUBLICATIONS

*Kite Lines,* Summer 1986, pp. 64–67, "For the Record".
*Kite Lines,* Winter–Spring 1987, p. 56.

*Primary Examiner*—Galen Barefoot
*Attorney, Agent, or Firm*—Michael J. Weins

[57] ABSTRACT

The present invention relates to a control system for tethering an airborne object such as a kite or an airplane. The system in its simplest form has an anchor which attaches to a pair of lines which in turn pass through a control bar. The control bar has a first end and a second end and centrally engages the lines. The lines pass through the control bar and are separated and directed to said first end and said second end of said control bar from which said lines advance to the airborne object. The present invention is to provide a control system for controlling kites and airplanes that will allow the lines to be altered in length without destabilizing the kite or plane being controlled and will provide a controller which serves as an accelerator assisting in the process of launching a kite thereby allowing the kite to be flown in winds otherwise too light to make flying possible.

9 Claims, 2 Drawing Sheets

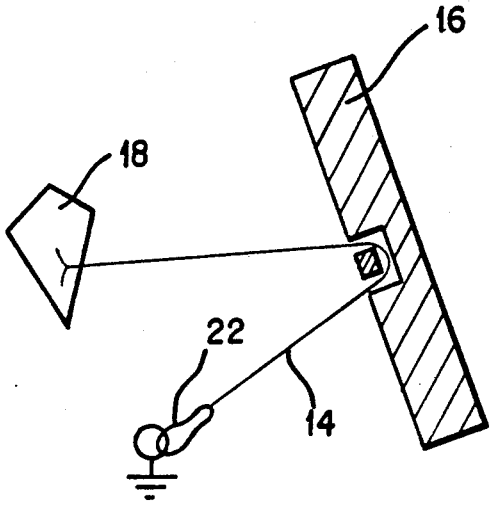
FIG. 1
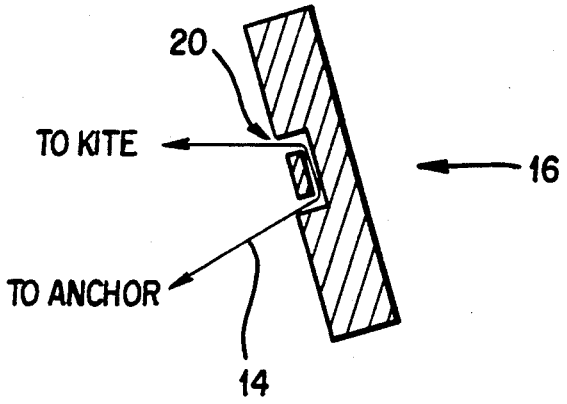
FIG. 2
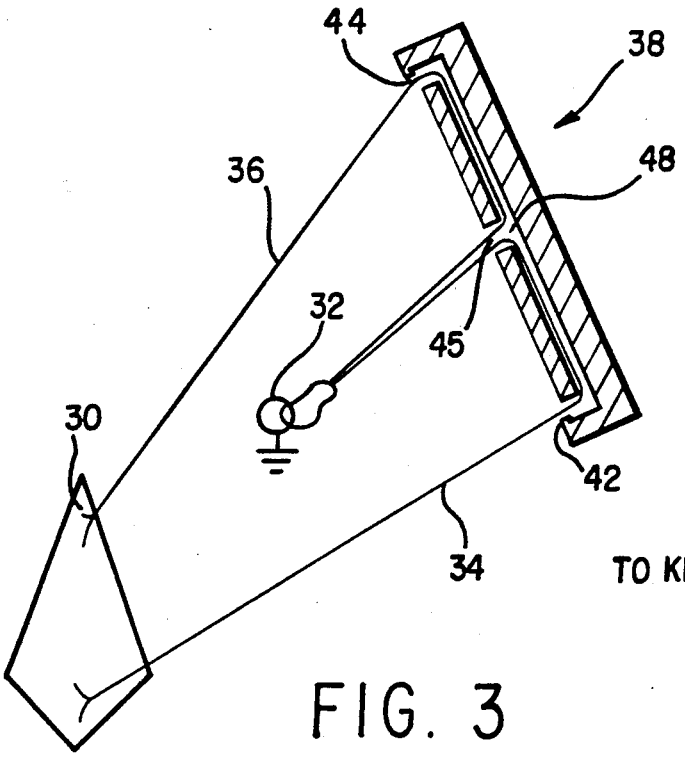
FIG. 3
FIG. 4
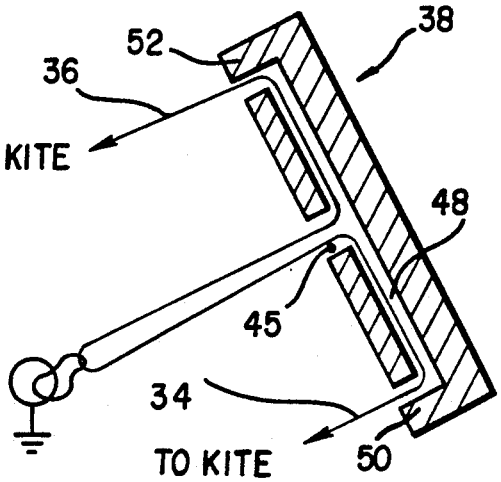

KITE CONTROLLER

FIELD OF THE INVENTION

The present invention is directed to a kite guidance system, and more particularly to a kite controller.

BACKGROUND ART

Controllers have long been used to regulate the motion of airborne objects on a tether. Kites have been classically tethered on a single line which could be pulled on to effect the kites interaction with the air currents. Model airplanes have frequently been controlled by the use of a dual line control system. The lines are connected to a handle in a spaced apart relationship and by pivoting the handle the effective lengths of the two lines can be changed, these changes being translated into changes in the inclination of the airplane's elevator and inducing a change in the flight path of the airplane.

Stunt kites employing multiple lines have been used to change the inclination of kites with respect to the wind direction causing the kites to move responsive to those changes. The lines have frequently been connected to a handle in a spaced apart relationship and by pivoting the handle the effective lengths of the two lines are changed tilting the kite with respect to its inclination to the wind.

One of the difficulties with multiple line control systems has been the difficulty in providing for a change in distance between the operator and the kite or airplane being controlled.

Dual spools have been employed to let out or take in additional line. However, these devices have not been effective since they are winding and unwinding against a differential tension resulting in unequal lengths of line being let out or taken in and destabilization of the flight path of the airplane or kite being controlled. This problem has in part been overcome by passing the two lines through an anchor ring between the control handle and the kite or airplane being controlled thereby. This provides a method for uniformly changing the length of the lines between the anchor and the kite or airplane by moving away from the anchor. This technique of flying finds limited application since the control becomes indirect and thus more difficult to introduce the desired control changes.

Thus there is a need for a direct control system that will allow lines to be uniformly released or taken in while a kite or plane is in flight.

SUMMARY OF THE INVENTION

It is an object of the present invention to provide a control system for controlling kites and airplanes that will allow the lines to be altered in length without destabilizing the kite or plane being controlled.

Another object of the present invention is to provide a controller which serves as an accelerator and will assist in the process of launching a kite thereby allowing the kite to be flown in winds otherwise too light to make flying possible.

A further object of the invention is to provide means for altering the velocity and acceleration of a kite during flight in a manner responsive to variable wind conditions.

Still another object is to provide means for storing the line when the system is not in use.

These and other objects will become apparent from the following description figures and claims.

The control system in its simplest form has an anchor to which is attached one or more lines which engage a control bar and pass therethrough and thereafter to a kite.

In a preferred embodiment the control system is used to tether an airborne object such as a kite or airplane with a pair of lines. For this embodiment the pair of lines are attached to the anchor. The control bar having a first end and a second end is provided with means for centrally engaging the pair of lines, separating the lines and releasing them in the vicinity of the first end and the second end of the control bar.

In one preferred embodiment the lines are guided by eyelets which are held away from the bar by spacers to provide for gripping of the handle while avoiding hand contact with the lines.

BRIEF DESCRIPTION OF THE DRAWINGS

FIG. 1 is one embodiment of the present invention where a single line is used to tether a kite. The line is directed through a passage internal to the control bar.

FIG. 2 is a cross section of the control bar of the embodiment of FIG. 1.

FIG. 3 is a second embodiment of the invention where a pair of lines are employed in the controller and are guided through internal passage of the control bar.

FIG. 4 is a cross section of the control bar of FIG. 3.

BEST MODE FOR CARRYING THE INVENTION INTO PRACTICE

Figure 5:
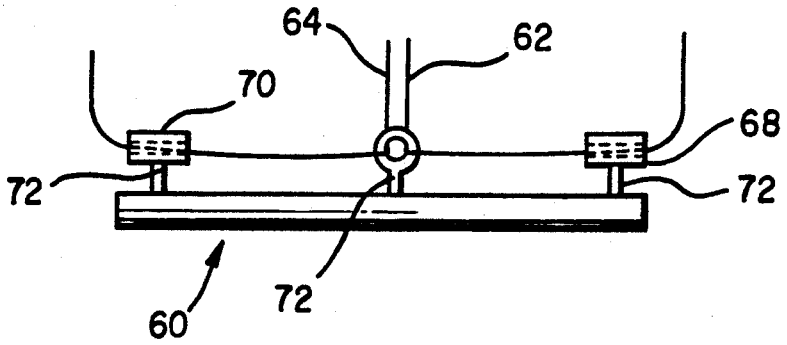
FIG. 5 is another control bar for a two line control system where the lines pass through eyelets that are held away from the control bar by spacers. The spacers in combination with the eyelets provide a reel for storage of the line when the controller is being stored.

FIG. 1 is one embodiment of the present invention for controlling a kite with a single line. An anchor 12 is provided to which a line 14 is attached. The line 14 slidably engages a control bar 16. The control bar 16 is positioned along the line 14 between the anchor 12 and a kite 18. The control bar 16 illustrated in FIG. 2 has a central passage through which the kite line passes. Alternatively an eyelet or a pulley can be employed through which the line 14 will pass.

The line length can be fixed with respect to the control bar by rotating the control bar 16 resulting in the line 14 wrapping around the control bar 16. After rotating the control bar 16, the control bar 16 grips the line 14 in such a manner that the line 14 will not slip.

In one preferred embodiment the line 14 attaches to the anchor 12 with a catch 22 (See FIG. 1) the catch 22 is of sufficient size so as to not pass through the central passage 20 of the control bar 16 thereby locking the anchor end of the line 14 with respect to the control bar when the line 14 is released from the anchor 12.

FIG. 3 is a kite control system for controlling a two line airborne object such as a model airplane or stunt kite with the system being illustrated for a stunt kite 30. The kite 30 illustrated is the subject of a co-pending patent application by the same inventor. The control system has an anchor 32. A first control line 34 and a second control line 36 are attached to the anchor 32. A control bar 38 having a first end 42 and a second end 44 has means for controlling, engaging and passing, separating and directing the lines to the first end 42 and the second end 44 the first control line 34 and the second control line 36. The means centrally illustrated in FIG. 3 has a central port 45 in the control bar 38 which opens into a central passage 48 in the control bar 38. After passing through the central port 46 the lines separate in the central passage 48 with the lines exiting the controller bar 38 through ports located near the first end 42 and the second end 44 of the control bar 38. The first line 34 passing through a first exit port 50 and the second line 36 passing through a second exit port 52.

FIG. 4 is a cross section of the control bar 38 of FIG. 3 which illustrates the central passage 48 through which the lines pass. The first line 34 and the second line 36 which attach to the anchor 32 enter the central passage 48 through a central port 45 and thereafter the lines separate with the first line 34 exiting from the first exit port 50 and the second line 36 exiting through the second exit port 52 of the central passage 48.

FIG. 5 is an alternate embodiment of the control bar for the control system of the present invention. The control bar 60 maintains the first line 62 and the second line 64 external to the control bar 60. The lines (62, 64) connected to the anchor (not shown) pass through a central eyelet 66 as a pair. The central eyelet 66 serves as the means for centrally engaging and passing the first and second lines. The lines then separate passing through external eyelets. The first line 62 passing through a first outer eyelet 68 and the second line 64 passing through a second outer eyelet 70. Spacers 72 are provided to assure separation between the eyelets and the control bar and prevent the lines contacting the hands of the operator during use. The spacers 72 in combination with the eyelets (66, 68 & 70) provide a spooling rack for storing the lines when the control system is not being used.

Figure 6:
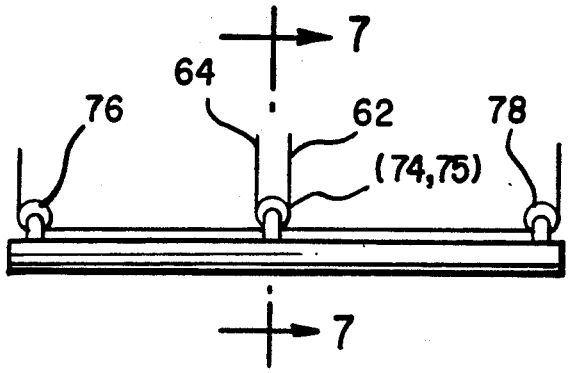
FIG. 6 is a variation of the control bar of FIG. 5 where pulleys are substituted for eyelets.
Figure 7:
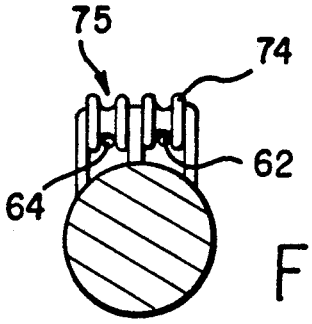
FIG. 7 is a cross section 7—7 of FIG. 6.

FIG. 6 shows a variation embodiment of FIG. 5 wherein pulleys are employed rather than eyelets. In this embodiment the means for centrally engaging and passing the first line 62 and the second line 64 is a pair of central pulleys (74, 75) which are shown in cross section in FIG. 7. The first central pulley 74 guides the first line 62 while the second central pulley 75 guides the second line 64. The pair of pulleys keeping the lines in close proximity but allows separation of the two lines as they pass over the pair of pulleys (74,75). As the lines pass over the pulley pair they are separated with the first line 64 after passing over the first center pulley 74 being guided by the first end pulley 76 and the second line 64 after passing over the second central pulley 75 being guided by the second end pulley 78.

Figure 8:
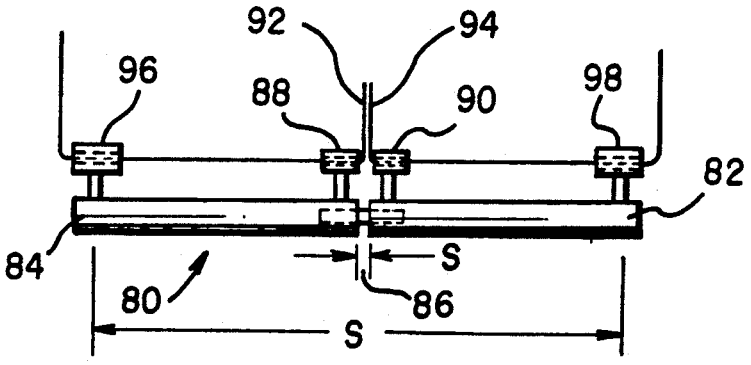
FIG. 8 illustrates an embodiment where the control bar is separable into two sections.

FIG. 8 illustrates another embodiment of the present invention where the control bar has two sections which separate and allow the lines to be separated and manipulated independently. In this embodiment control bar 80 has a first bar section 82 and a second bar section 84. The first bar section 82 attaches to the second bar section 84 at an interface 86 with an engaging means. The means illustrated is a peg-channel coupling. The means for centrally engaging and passing the first and second lines are a pair of central eyelets (88, 90) in close proximity to the means for engaging 86 the first section 82 and the second section 84. The first central eyelet 88 guides the first line 92 of the pair of central eyelets and a second central eyelet 90 of the pair of central eyelets guides the second line 94. The first line 92 and the second line 94 enter the space between the first central eyelet 88 and the second central eyelet 90 and thereafter separate with the first line 92 passing through the first central eyelets 88 and the first external eyelet 96 and the second line 94 passing through the second central eyelet 90 and a second external eyelet 98.

It is preferred that the separation s between the central eyelets be less than about 10% of the separation S between the external eyelets as to assure minimum change in the length of the lines and predictable response to the control bar when it is operated as a unit.

Figure 9:
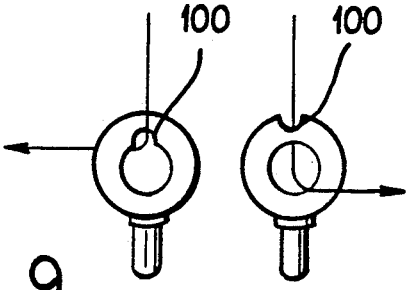
FIG. 9 illustrates a split central control ring having a common inlet passage for the lines from the anchor.

FIG. 9 illustrates a preferred inner pair of eyelets with groves 100 to allow passage of the lines between the inner inner eyelets when the separation s is reduced to zero.

What I claim is:

1. A control system for tethering an airborne object such as a kite or an airplane comprising:

an anchor;

a pair of lines;

means for attaching said lines to said anchor; and a control bar having a first end and a second end, said control bar being provided with means for centrally engaging and passing said pair of lines, separating said lines, and directing said separated lines to said first end and said second end of said control bar from which said lines advance to the airborne object, said control bar being spaced apart from said anchor and positioned along said pair of lines between said anchor and the airborne object.

2. The control system of claim 1 wherein said means for centrally engaging and passing said pair of lines, separating the lines, and directs said separated lines to the extremities where said lines advance to the airborne object further comprising:

at least one central eyelet through which the pair of lines pass; and two external eyelets which are spaced apart having a distance S there between attached to said control bar, each of said external eyelets passing one line of said pair of lines, with said spaced apart eyelets being symmetrically located with respect to said central eyelet and in close proximity to said first end and said second end of said control bar.

3. The control system of claim 2 wherein spacers are provided between said eyelets and said control bar, said spacers being of sufficient size to allow fingers to be placed between said control bar and said first line and said second line.

4. The control system of claim 1 wherein said means for centrally engaging and passing said pair of lines, separating said lines, and directs said separated lines to the extremities of said control bar from which said lines advance to said airborne object further comprises:

a pair of central pulley through which the pair of lines pass with each of said pulleys of said pair of pulleys passing one line of said pair of lines; and two external pulleys which are spaced apart attaching to said control bar, each of said spaced apart pulleys passing one line of said pair of lines and said spaced apart pulleys being symmetrically located with respect to said first pulley and in close proximity to said first and said second end of said control bar.

5. The control system of claim 4 wherein spacers are provided between said pulleys and said control bar, said spacers being of sufficient size to allow fingers to be placed between the handle and said lines.

6. The control system of claim 2 further comprising a second central eyelet in close proximity to said first central eyelet forming a central eyelet pair with a separation s there between wherein said first line and said second line pass between said central eyelet pair and said first line passing through said first central eyelet and said second line passing through said second central eyelet.

7. The control system of claim 6 wherein said control bar has a first section and a second section, said first section and said second section meeting at an interface; means for engaging said first and second section; and further wherein said central eyelet pair are positioned with respect to said means for engaging said first eyelet is attached to said first section and said second eyelet is attached to said second section with said first eyelet and said second eyelet being in close proximity to said interface.

8. The control system of claim 7 wherein spacers are provided between said eyelets and said control bar, said spacers being of sufficient size to allow the fingers to be placed between said control bar and said lines.

9. The control system of claim 8 wherein said separation s between said central eyelet is less than about 10% of said distance S between said two spaced apart eyelets.

* * * * *